United States Patent [19]

Holtzman et al.

[11] Patent Number: 4,735,148

[45] Date of Patent: Apr. 5, 1988

[54] PLASTIC COMPOSITE SABOT

[75] Inventors: Allen L. Holtzman, Cupertino; Forest R. Goodson, San Jose, both of Calif.

[73] Assignee: United Technologies Corporation, Hartford, Conn.

[21] Appl. No.: 14,200

[22] Filed: Feb. 5, 1987

Related U.S. Application Data

[63] Continuation of Ser. No. 840,809, Mar. 18, 1986, abandoned.

[51] Int. Cl.[4] ..... F42B 13/16

[52] U.S. Cl. ..... 102/522

[58] Field of Search ..... 102/520–528, 102/532

[56] References Cited

U.S. PATENT DOCUMENTS

| | | | |
|---|---|---|---|
| 2,638,051 | 5/1953 | Critchfield | 102/522 |
| 2,983,225 | 5/1961 | Walker | 102/93 |
| 3,334,588 | 8/1967 | Larson | 102/42 |
| 3,359,905 | 12/1967 | Engel | 102/93 |
| 3,446,147 | 5/1969 | Engel et al. | 102/522 |
| 3,496,869 | 2/1970 | Engel | 102/522 |
| 3,551,972 | 1/1971 | Engel | 29/1.23 |
| 3,802,345 | 4/1974 | La Costa | 102/93 |
| 3,859,922 | 1/1975 | Kaplan | 102/93 |
| 3,862,603 | 1/1975 | Kornblith et al. | 102/93 |
| 3,877,383 | 4/1975 | Flatau | 102/524 |
| 3,882,777 | 5/1975 | Rausing | 102/38 |
| 3,905,299 | 9/1975 | Feldmann | 102/522 |
| 3,948,184 | 4/1976 | Pierre et al. | 102/522 |
| 4,128,259 | 4/1979 | Yuhash | 102/93 |
| 4,296,687 | 10/1981 | Garrett | 102/518 |
| 4,314,510 | 2/1982 | Jeter et al. | 102/523 |
| 4,430,943 | 2/1984 | Bock et al. | 102/522 |
| 4,434,718 | 3/1984 | Kopsch et al. | 102/522 |
| 4,476,785 | 10/1984 | Hoffman et al. | 102/522 |
| 4,505,204 | 3/1985 | Wikstrom | 102/523 |

FOREIGN PATENT DOCUMENTS

| | | |
|---|---|---|
| 524168 | 11/1953 | Belgium . |
| 2032070 | 4/1980 | United Kingdom . |

*Primary Examiner*—Harold J. Tudor

*Attorney, Agent, or Firm*—William J. Sapone

[57] ABSTRACT

A plastic composite sabot (1) includes an integrally molded rearwardly located deformable shoulder (6) which engages the grooves (10) in a rifled barrel (7). The sabot also includes mid and forward sections (4) and (5) which engage the lands (11) in the rifled barrel, and, an axially disposed projectile retaining chamber (13). An obturator (17), attached by pins to the sabot, drives the sabot and projectile through the barrel on firing. Utilizing a unitary plastic composite sabot substantially lessens manufacturing costs and increases projectile stability while reducing overall weight, thereby optimizing projectile velocity and accuracy while minimizing costs.

4 Claims, 1 Drawing Sheet

FIG. 1
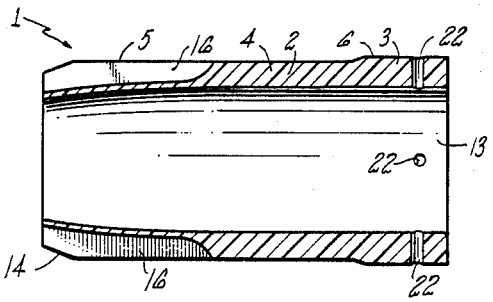
FIG. 2
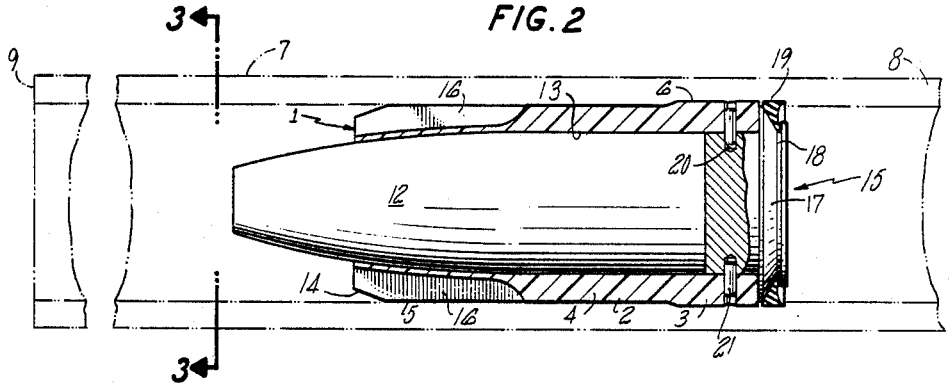
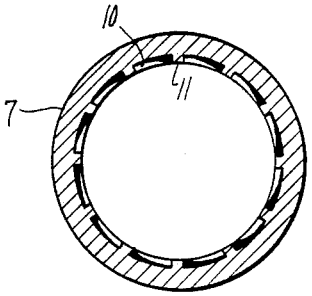
FIG. 3

PLASTIC COMPOSITE SABOT

This application is a continuation of Ser. No. 840,809 filed on Mar. 18, 1986 and now abandoned.

DESCRIPTION

1. Technical Field

This invention relates to sabots and more particularly to unitary plastic composite sabots used to position subcaliber projectiles in full caliber gun barrels.

2. Background Art

It is well known in the art that utilizing a subcaliber projectile in a full caliber barrel bore can significantly increase the muzzle velocity of gun fired projectiles. Since subcaliber projectiles are lighter in weight than full caliber projectiles, exposure to a full caliber propellant charge will signficantly increase the subcaliber projectile's velocity and range. High velocity projectiles provide enhanced striking power and are particularly suited for use in armour piercing weapons. Such subcaliber projectiles are generally placed in detachable sabots which enter the projectile in the barrel and provide a full caliber barrel sealing surface which imparts spin to the projectile during acceleration, stablizing the projectile during free flight.

A variety of materials and designs have been proposed for sabots. Most are multicomponent designs such as U.S. Pat. No. 4,476,785 to Hoffman et al, which utilizes a hood secured by rims and wedges to a sabot and utilizing a spring ring which holds a projecticle in the sabot, or, U.S. Pat. No. 4,296,687 to Garrett which utilizes a segmented plastic sabot with a serverable segment retaining band. Others, such as U.S. Pat. No. 2,638,051 to Critchfield, utilize a sliding barrellet and distendable rings for centering and rotating the projectile. Generally, most sabots presently used include a number of parts individually fabricated, with most primarily constructed from metal. Such metal parts are trimmed, such as by machining hollow cavities, to reduce the overall weight of the subcaliber assembly. Such voids in the metal parts provide a site for failure on firing, such as by warping due to the high acceleration forces. Should the sabot fail or break apart in the barrel, such metal parts could damage or become lodged in the barrel. Similarly, such a failure could significantly upset the centering of the projectile, detrimentally effecting the stability and accuracy of the projectile during flight.

Multicomponent sabots, having parts fabricated from metal, plastic or other materials, are costly to produce, may present an unacceptically high risk of failure during barrel traversal, and, generally require complicated assembly procedures. In addition, sabots which utilize machined grooves or recesses on a projectile shell for attaching the sabot to the projectile, require modified munitions and therefore have limited applicability due to the high costs involved in such modified munition production. For example, the sabot assembly disclosed in U.S. Pat. No. 3,862,603 to Kornblith et al utilizes a segmented petal sabot which engages grooves in a projectile skin. Such a sabot may not generally be utilized with standard issue projectiles.

In order to obtain optimum velocity and minimize deviation during free flight, a sabot must disengage from the projectile immediately after discharge from the gun barrel. Generally, such sabots are designed to disengage from the projectile on discharge due to centrifigal force or air pressure acting on the sabot assembly. As with flight through the barrel, the more parts employed in the sabot, the higher the probability of unreliable performance on discharge. For example, if a snap projectile retaining ring, such as that used by Hoffman, et al, fails to properly disengage from the mating groove in the projectile skin, the projectile could be tipped or encounter substantial aerodynamic drag on discharge, critically affecting the flight path and velocity of the projectile.

DISCLOSURE OF THE INVENTION

It is an object of the present invention to provide a plastic composite sabot usable on standard issue projectiles.

It is a further object of the present invention to provide a unitary lightweight sabot which can be mass produced at low cost.

It is a further object of the present invention to provide a sabot that does not have voids or projectile attaching means which may cause improper disengagement of the sabot from the projectile with consequent instability of the projectile on discharge from a gun.

These and other objects of the present invention are achieved by utilizing a unitary plastic composite sabot comprising a cylindrical body having an essentially full caliber outside diameter sized to engage the lands of a rifled barrel, an inner projectile retaining chamber essentially sized to contain a substantial portion of a subcaliber projectile and including a rearwardly located radially deformable shoulder comprising an elevated platform sized to engage the grooves of the rifled barrel. An obturator is attached to the sabot and acts as a drive member, sealing the assembly from the propulsion gases and thereby driving the sabot and subcaliber projectile through the barrel. In the preferred embodiment, the obturator is attached to the sabot by pins after a subcaliber projectile is loaded into the retaining chamber.

BRIEF DESCRIPTION OF THE DRAWINGS

FIG. 1 is a cross sectional view of the plastic composite sabot of the present invention.

FIG. 2 is a cross sectional view of a subcaliber projectile assembly, utilizing the plastic composite sabot of the present invention, disposed in a rifled barrel.

FIG. 3 is a sectional view taken in the direction of line 3—3 of FIG. 2.

BEST MODE FOR CARRYING OUT THE INVENTION

For illustrative purposes, a plastic composite sabot sized to accommodate a 75 milimeter projectile in a 105 milimeter cannon is discussed. While such sizes are exemplary, it will be understood by those skilled in the art that any subcaliber spin stabilized projectile could benefit from this invention. Referring to FIG. 1, a sabot 1 has an essentially cylindrical body 2, with a rearward section 3, a middle section 4, and a forward section 5. An integrally molded radially outwardly extending shoulder 6, is located at rearward section 3. For illustrative purposes, plastic composite sabot 1 is composed of polypropylene, such as Dypro® type 8810Z manufactured by Atlantic-Richfield company. While polypropylene is exemplary, any moldable plastic may be used. However, fiber composite mateials are not preferred due to their detrimental effect on uniform disintegration. Polypropylene is the optimal material of construction because it provides sufficient handling strength to prevent damage during loading yet is suffiently weak to assure immediate destruction on discharge from a gun.

Referring to FIG. 2, a 105 mm cannon barrel 7, shown in phantom, has a breech 8 and a muzzle 9. Barrel 7 has spiral rifling comprising alternating grooves 10 and lands 11 which induce the spinning of a projectile passing therethrough. For a 105 mm cannon, such grooves may have a depth of 0.040–0.050 inches. While such depths are exemplary, it will be understood by one skilled in the art that any depth rifling could be accommodated by this invention. Shoulder 6 is sized to deformably engage grooves 10 of rifled barrel 7 on loading, requiring a circumferential elevation of 0.040–0.050 inches. The use of polypropylene facilitates the deformable engagement of the shoulder with the barrel rifling grooves. Midsection 4 and forward section 5 of sabot 1 are diametrically sized to provide surface engagement with lands 11 of rifled barrel 7. A subcaliber projectile 12 is inserted into a projectile retaining chamber 13 in sabot 1, with chamber 13 essentially matching the contours of projectile 12. As is seen in FIG. 2, projectile 12 is substantially embedded in sabot 1. Such engagement, which may vary with a particular application, increases axial stability of the projectile during firing, increasing the accuracy of projectile 12 after discharge from the barrel. Forward section 5 includes an integrally molded beveled nose 14 which facilitates ramming of a subcaliber assembly 15 into barrel 7. While such a nose eases loading, it is not required to achieve the benefits of the present invention. Similarly, forward section 5 is shown with slots 16 which provide weakening structures on sabot 1. Such weakening structures may facilitate destruction of the sabot on discharge by promoting destruction of the sabot into controlled segments and may vary in shape, depth and length, depending on the particular application. Such slots are not required to achieve the reliability benefit of the present invention. However, it should be noted that such beveling, slots or other structures may easily be incorporated into a mold without adding substantially to the cost of an individual sabot. For a 75 mm projectile in a 105 mm cannon, four slots are provided having an 80% radial penetration depth, and a length of about three inches.

An obturator 17 is fitted to rearward section 3 of sabot 1. Obturator 17, preferably composed of aluminum, has a diameter essentially matching the inner diameter of barrel 7, and a circumferential slot 18 which receives a ring seal 19, preferably composed of soft rubber. Such an obturator with a soft seal prevents gas leakage through the rifling grooves during firing, maximizing propulsion efficiency. Obturator 17 includes pin receptacles 20 and is attached to sabot 1 by pins 21 which are press fitted through pin insertion passages 22 into receptacle 20. Other suitable attaching means may also be used.

In operation, a propellant charge is ignited behind obturator 17, generating gas which forces the obturator, sabot and projectile through the barrel. Shoulder 6, having engaged the grooves 10 in the rifling, spins sabot 1. Midsection 4 and forward section 5 engage the lands 11 in the rifling, maintaining axial stability of the assembly 15 as it passes through the barrel. As sabot 1 centrifically accelerates, sections 4 and 5 are driven into engagement with grooves 10, further stabilizing projectile 12. Projectile 12, frictionally engaged with obturator 17 by linear acceleration forces, spins with sabot 1.

On discharge from the barrel, the centrifugal force and air resistance encountered causes sabot 1 to be cast off, centrifically disintegrating it into small particles. Such centrifugal forces are substantial as the assembly exits muzzle 9 spinning at approximately 45,000 RPM. Projectile 12 is undisturbed by the near instantaneous shedding of sabot 1 and continues its high-velocity flight.

Minimizing the number of parts utilizied in the present invention substantially increases reliability while minimizing production costs. By making modifications, such as slots, in a mold rather than to individual components assures ease of mass producing the sabots. Since the projectile and sabot form a solid yet low weight assembly, voids or hollow areas are avoided, reducing the likelihood of failure and damage to the barrel. With the inventive sabot, modified projectiles are unnecessary thereby reducing the need for high cost projectiles, lessening the overall cost of a subcaliber round and further improving the mass producability and cross-service utility of the present invention.

While this invention is discussed in relation to a 75 milimeter projectile in a 105 milimeter cannon, it will be understood by those skilled in the art that any changes in barrel diameter, subcaliber projectile diameter, propulsion means or sealing means could be made without varying from the present invention.

What is claimed is:

1. In a subcaliber projectile assembly which includes a sabot, a projectile disposed within said sabot and a rearwardly located obturator, wherein said assembly is fireable through a rifled barrel, the improvement characterized by:

said sabot comprising a generally cylindrical unitary body made from a moldable plastic, said body having an outside diametric surface which provides engagement of said body with the lands of said rifled barrel, said sabot further including a rearwardly located radially deformable shoulder, diametrically sized to provide engagement thereof with the grooves of said rifled barrel, and including means for attaching said obturator to said body at a rearward section thereof, said means comprising pin insertion passages provided within said body, and pin means, said obturator having pin receptacles dipsosed therein for receiving said pin means, said obturator engaging said projectile solely at its rearward base, said sabot having a projecitle retaining chamber axially disposed within said body, essentially matching the contours of said projectile disposed therein, said sabot further including a forward section of reduced diameter for retaining said projectile within said sabot, said projectile substantially but not completely embedded within said body, said projectile sidewall solely supported by said sabot, whereby a solid, void free assembly is formed which maintains the axial and lateral stability of said projectile, said sabot being separably manufacturable for later incorporation with said projectile and said obturator.

2. The assembly of claim 1 wherein the body includes forwardly located integrally molded weakening structures.

3. The assembly of claim 2 wherein said structures comprise slots.

4. The sabot of claim 1 wherein said moldable platic provides sufficient handling strength while simultaneously being sufficiently weak to insure immediate destruction into small particles on discharge from a gun.

* * * * *